United States Patent [19]

Trafford et al.

[11] 4,280,120

[45] Jul. 21, 1981

[54] FIRE ALARM SIGNAL STATION

[75] Inventors: Larry F. Trafford; John W. K. Thompson, both of Owen Sound, Canada

[73] Assignee: General Signal Corporation, Stamford, Conn.

[21] Appl. No.: 141,494

[22] Filed: Apr. 18, 1980

[51] Int. Cl.[3] ..... G08B 25/00

[52] U.S. Cl. ..... 340/303

[58] Field of Search ..... 340/301, 303, 308

[56] References Cited

U.S. PATENT DOCUMENTS 2,594,369 4/1952 Verkuil ..... 340/303

*Primary Examiner*—Harold I. Pitts

*Attorney, Agent, or Firm*—Milton E. Kleinman; George W. Killian

[57] ABSTRACT

This disclosure relates to an apparatus for fire alarm signaling which is economical and versatile and which makes use of the properties and characteristics of the material of which it is made. All components of the assembly snap together. An auxiliary cover as well as the main cover may be used. A lower break-rod is mounted on the base and cammed aside as the main cover is closed and then the break-rod returned to a position to be broken in response to opening the main cover, an upper break-rod may be associated with the auxiliary cover. Up to three switches may be provided and each has a latched position. A simple tool is used to release the switch latch. The latch comprises an integral part of the base and/or switch stems. During assembly selected elements may be selectively oriented to make any switch have either normally-open or normally-closed contacts. The catch between the main cover and base permits easy actuation and yet inhibits false actuation in response to a blow. No internal wiring is required.

50 Claims, 26 Drawing Figures

FIG. 12A
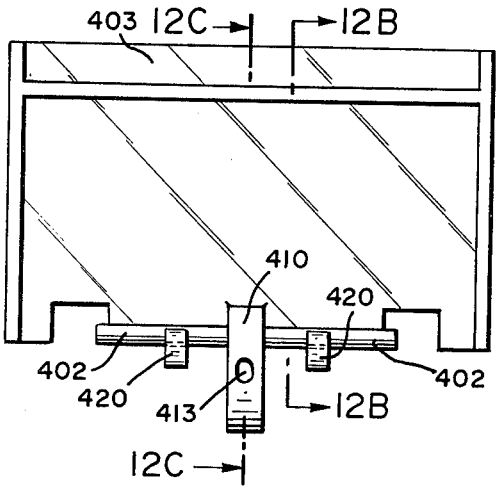
FIG. 12B
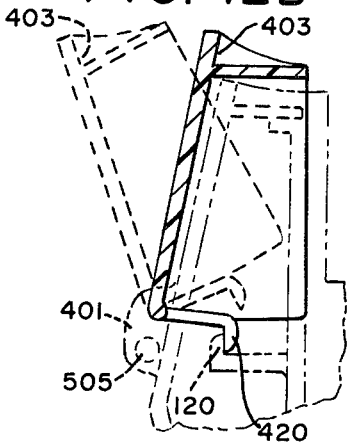
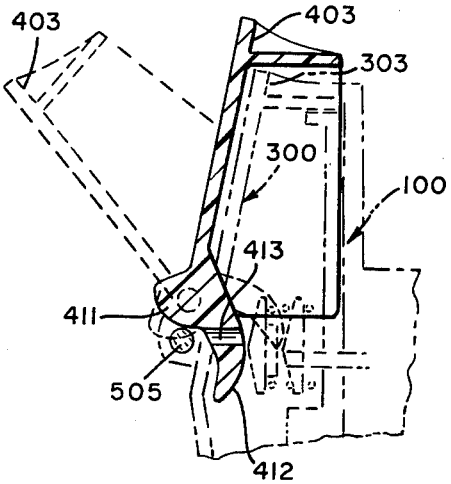
FIG. 12C
FIG. 13
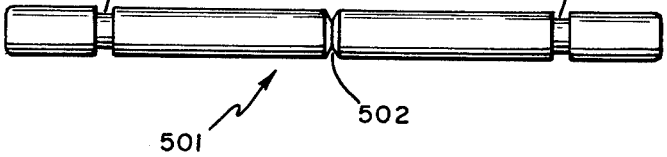

FIRE ALARM SIGNAL STATION

BACKGROUND OF THE INVENTION

Fire alarm boxes are commonly used in municipalities and buildings so that an individual who discovers a fire can expeditiously originate an alarm signal to summon aid. Although a wide variety of fire alarm boxes have been developed with numerous combinations of features there are several features and characteristics which dominate. Features which may be incorporated in the fire alarm box of the present invention include:

- a switch acutated in response to the physical act of originating an alarm and which cannot be restored to normal or standby position except by an authorized individual in possession of a suitable key;
- psychological deterrents to the origination of a "false alarm"; and
- optional auxiliary switches for testing; providing local alarms or other purposes as may prove expedient.

Prior fire alarm boxes have served admirably, but the varying requirement of combinations of features has caused inventory and repair problems. The present invention teaches a fire alarm box comprising a reduced number of components and yet which can be optionally assembled or modified to suit the exigencies of nearly any specific requirement.

PRIOR ART

As mentioned, prior art devices have provided a wide range of features. Typical features and designs may be seen in the following U.S. patents, all of which are assigned to the same assignee as the present application:

- No. 2,594,369 Alarm Signal Station issued June 8, 1937 to R. S. Edwards discloses prior art stations made of metal and includes switch and glass breaking details;
- No. 2,594,369 Fire Alarm Signal Station Box issued Apr. 29, 1952 to Leo L. Verkuil et al discloses structure with a glass break-rod and includes coded signal apparatus.
- No. 2,632,070 Alarm Signal Station issued Mar. 17, 1953 to L. L. Verkuil discloses a molded plastic case and techniques for mounting and breaking a breakable element.
- No. 2,698,354 Construction for Electrical Connections in Electric Signaling Apparatus issued Dec. 28, 1954 to L. L. Verkuil et al is a division of No. 2,594,369 mentioned above and particularly relates to convenient electrical connections.
- No. 2,726,381 Alarm Signal Station issued Dec. 6, 1955 to L. L. Verkuil discloses a non-coded station which is made of metal. Latches and break-rod are included.
- DES 168,149 and DES 168,150 Fire Alarm Signal Box issued Nov. 11, 1952 to R. S. Edwards et al discloses a box with a pull door.
- U.S. Pat. Nos. 3,715,743 and 4,017,844 issued Feb. 6, 1973 and Apr. 12, 1977 are assigned to Simplex Time Recorder Co. And Walter Kidde and Co., Inc., respectively. The former has an alarm actuating handle inside a glass window and includes a glass break-rod. The operating handle is latched in actuated position until restored by key actuation. The latter relates to Zoned Systems and release of fire extinguishing agents in response to manual operation of the station.

It is believed that these patents are representative of the variety of features and structures of the prior art.

OBJECTS

It is an object of this invention to provide a new and improved fire alarm signal of the non-coded type which is economical and versatile.

It is a more specific object of the invention to provide an improved signal device which is fabricated of fewer parts than prior art devices.

It is another object of the invention to provide a structure which may be readily and conveniently modified in factory and/or field to provide a variety of combinations of features.

It is yet another object of the invention to provide a device with a switch which latches in operated position when the alarm cover is opened; but which may be readily restored by means of a simple tool.

It is another object of the invention to provide an alarm box of the type described which may be equiped with an optional auxiliary switch which is latched in an operated position in response to actuation of an auxiliary cover.

It is yet another object of the invention to provide another optional auxiliary switch which may be selectively actuated for testing purposes.

It is another object of the invention to provide a break-rod support such that the break-rod is inserted in a base support member prior to closing of the cover.

It is another object of the invention to provide a break-rod support of the type described which will cause the break-rod to be broken when the cover is opened after it has been closed.

It is a more specific object of the invention to provide a break-rod support which permits camming the rod aside as the cover is closed.

SUMMARY OF THE INVENTION

The present invention comprises a versitile and economical fire alarm signal station which may be assembled or adapted to provide a wide combination of features. The fire alarm signal station of the present invention breaks with tradition in that the principal components are fabricated of plastic rather than comprising the traditional castings. Further, the design does not comprise a mere substitution of material as the new structure is designed to make use of the characteristics and properties of the material of which it is fabricated, to simplify assembly, reduce cost, and increase reliability and performance.

The structure may include a tamper cover and two break-rods to provide additional psychological deterrents to origination of false alarms. Most components take advantage of the yielding characteristic of the material of which they are made so that they are enabled to snap together. Selected components include yielding members which serve as springs and/or latches. The break-rods are easily inserted and yet unauthorized removal is virtually impossible. Up to three switches may be provided and each may be made to comprise normally-open or normally-closed contacts according to selected orientation of a part during assembly. Absolutely no internal wiring is required. Switches are quickly and conveniently reset by means of a simple tool inserted through a hole in the plunger cap.

The main cover is latched to the base by a simple latch which resists release in response to a blow and yet which yeilds to a mild pull by one intending to originate an alarm.

DESCRIPTION OF THE DRAWING

To permit incisive and detailed analysis of the operation and structure of the various components of the invention, several figures and views are provided. In order to facilitate identification and location of elements to which reference is made, the following numbering system is employed:

the first digit of each number identifies the major component of which the element is a part; and the second and third digits identify an individual element of the major component.

More specifically, the first digit:

1, indicates that the identified element comprises a part of the base;

2, indicates that the identified element comprises a part of the switches and/or related elements;

3, indicates that the identified element comprises a part of the main cover;

4, indicates that the identified element comprises a part of the tamper cover; and

5, indicates that the identified element falls into some other or miscellaneous category.

A given element is given the same identification number in all views.

Figure 2:
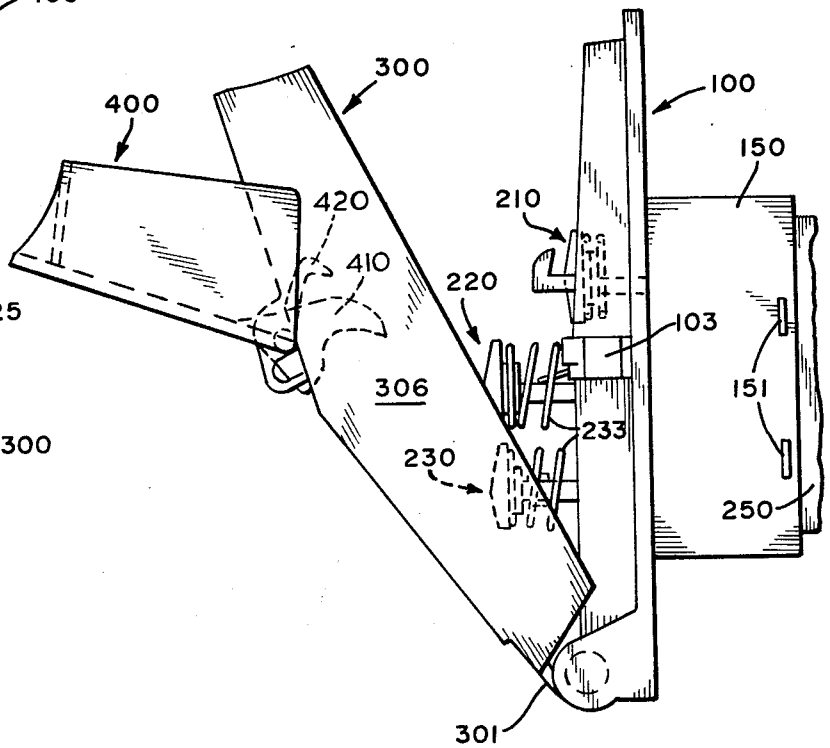
Figure 1:
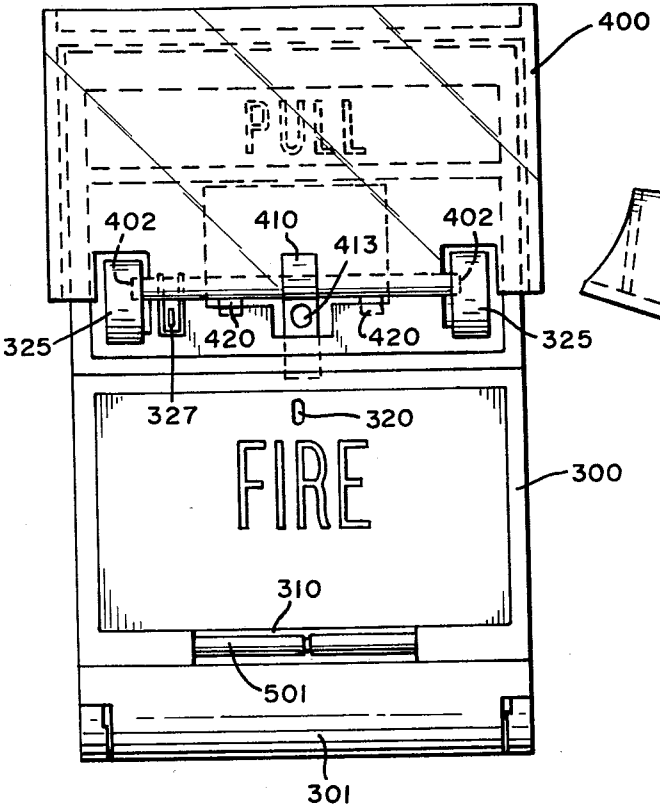
Figure 3:
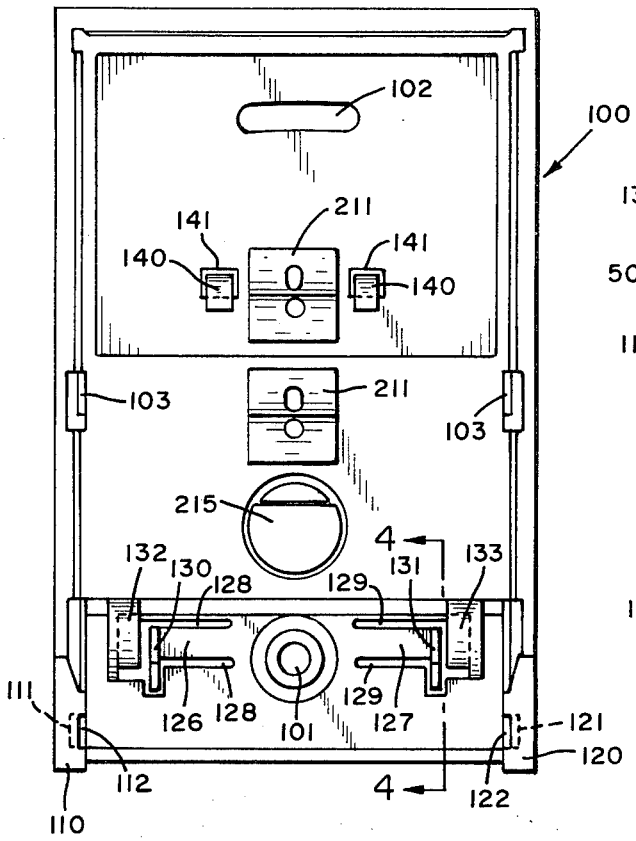
Figure 4A:
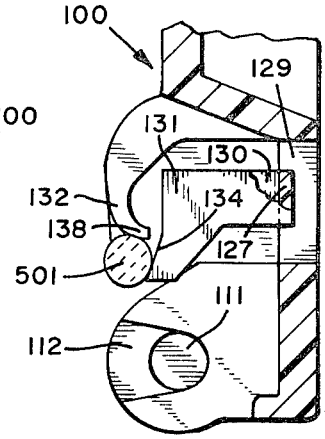
Figure 4B:
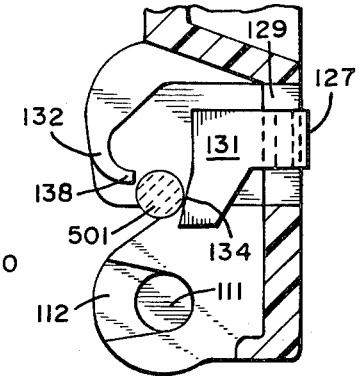
Figure 4C:
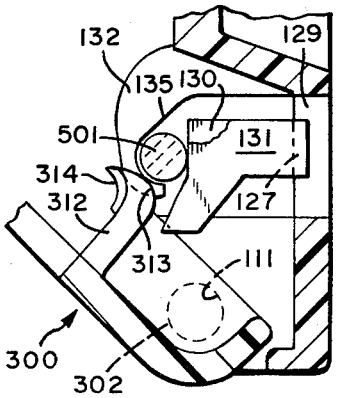
Figure 4D:
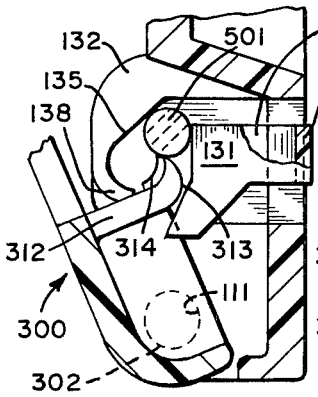
Figure 4E:
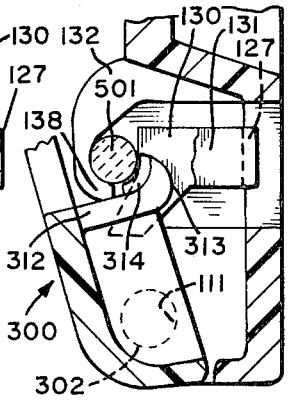
Figure 5A:
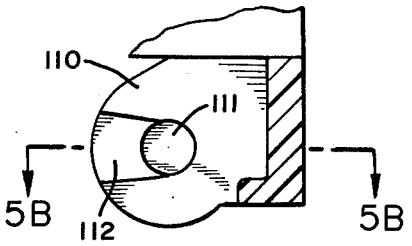
Figure 5B:
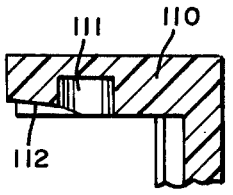
Figure 6A:
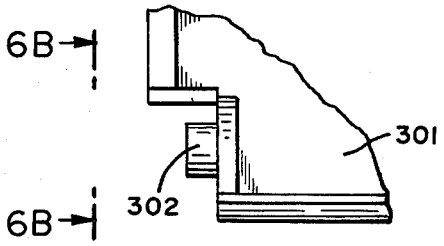
Figure 6B:
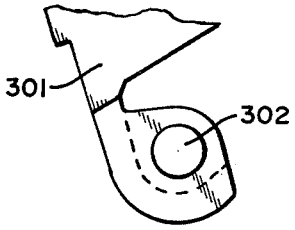
Figure 7A:
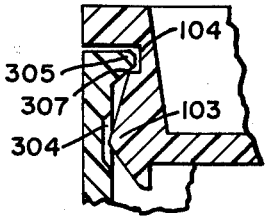
Figure 7B:
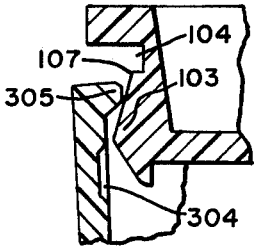
Figure 7C:
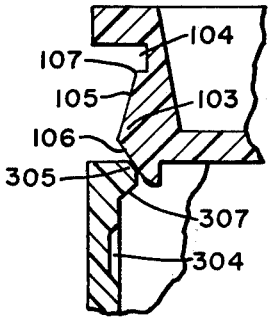
Figure 8:
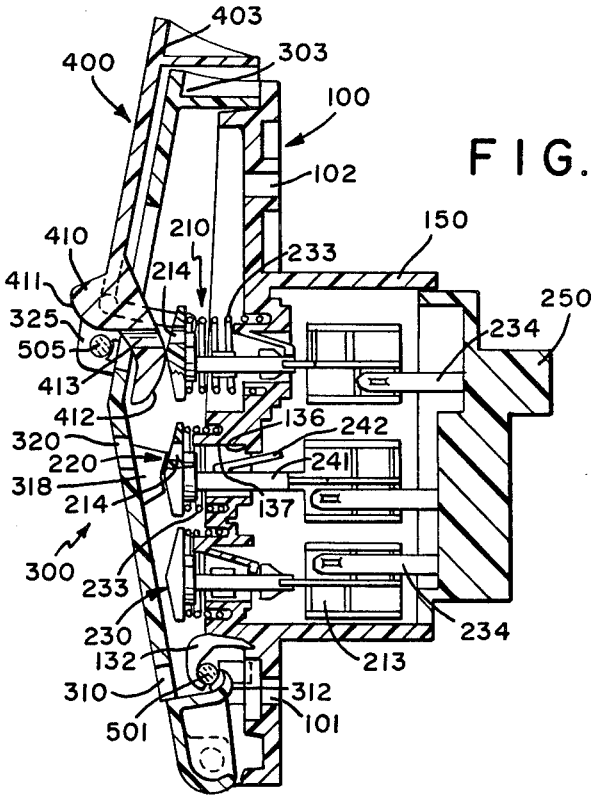
Figure 9:
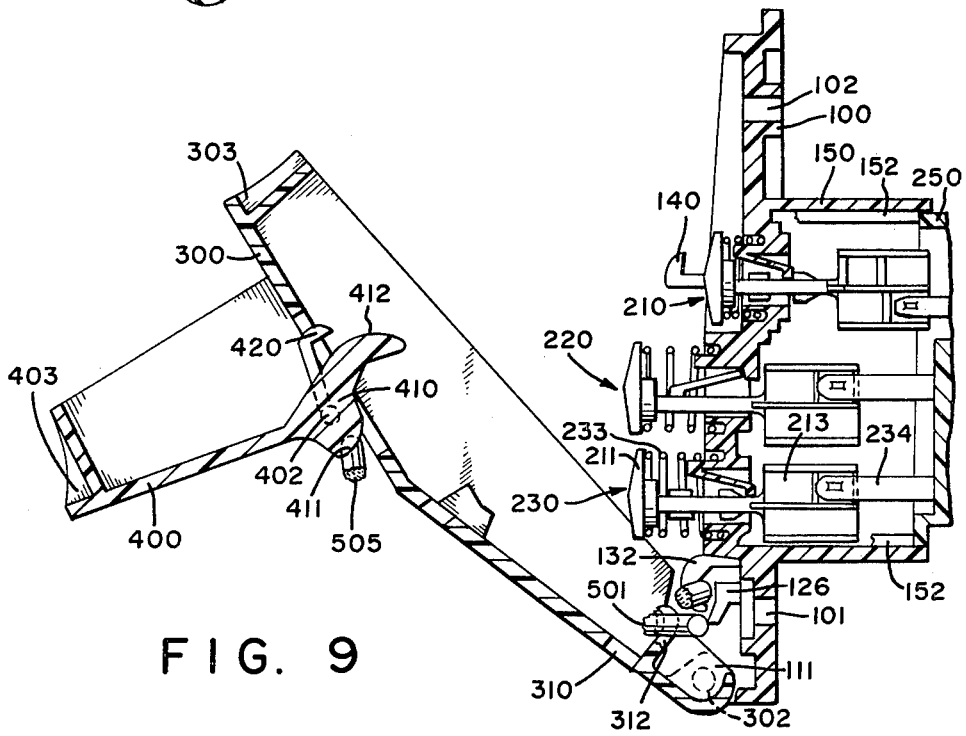
Figure 10:
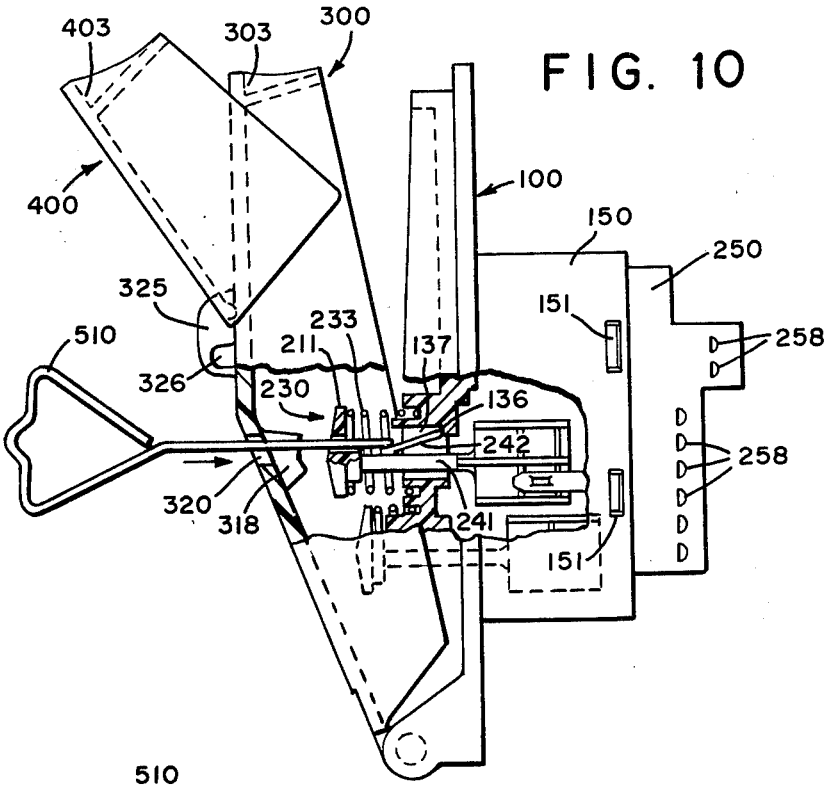
Figure 11A:
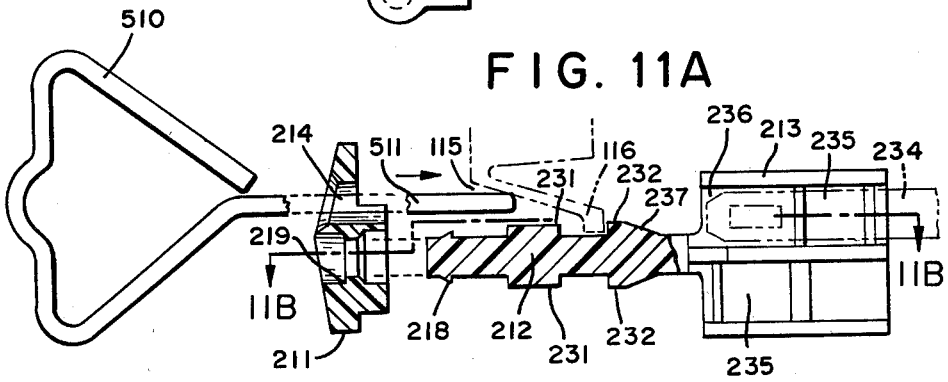
Figure 11B:
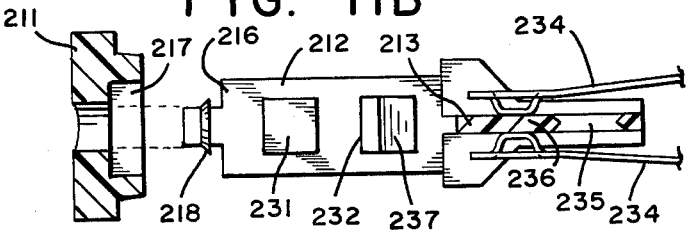
Figure 14:
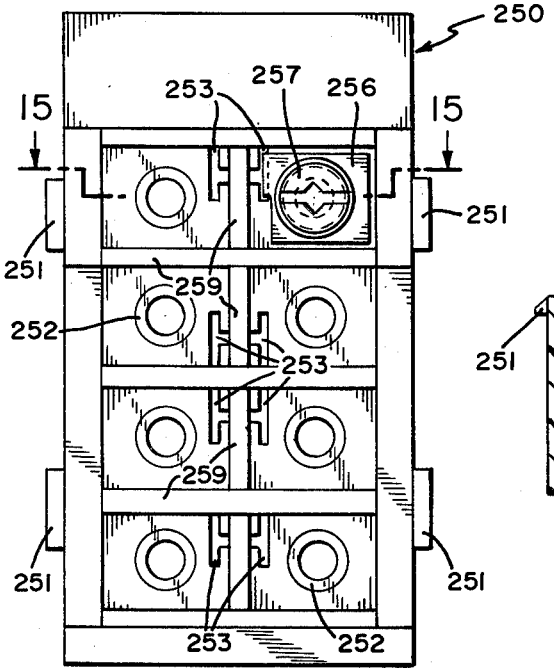

In the accompanying drawing:

FIG. 1 is a front view of a fire alarm box as it would appear in an installation and includes the tamper cover. The auxiliary break-rod is omitted to facilitate showing another element;

FIG. 2 is a side view of a fire alarm box showing both the main and tamper covers partly open;

FIG. 3 is a front view of the base with the main cover removed and with a blank inserted in place of the lower switch;

FIG. 4A is a partial side view showing initial placement for installation of the lower break-rod;

FIG. 4B is a partial side view showing an intermediate position of the break-rod during installation thereof;

FIG. 4C is a partial side view showing the normal position of the break-rod and the main cover cam for shifting the break-rod as the main cover closes;

FIG. 4D is a partial side view showing the near maximum displacement of the break-rod as the main cover is closed;

FIG. 4E is a partial side view showing the break-rod in position to be broken in response to opening of the main cover;

FIG. 5A shows a partial side view of the hinge well on the base;

FIG. 5B is a cross section along line 5B—5B of FIG. 5A;

FIG. 6A is a front view of a portion of the main cover showing the hinge pin;

FIG. 6B is a side view of the structure of FIG. 6A as seen from the plane 6B—6B;

FIG. 7A is a partial cross section view showing the main cover latched to the base;

FIG. 7B is similar to 7A but shows the main cover slightly displaced from the latched position;

FIG. 7C is similar to FIGS. 7A and 7B but shows the main cover completely unlatched;

FIG. 8 is a side cross section view to show the configuration and relationship of several elements with the main and tamper covers closed;

FIG. 9 is similar to FIG. 8 but shows both the main and tamper covers open so that the upper and middle switches are in their latched positions while the lower switch is illustrated in the released position as if it had been released by an authorized person in possession of a release key;

FIG. 10 is a side view, in partial cross section, to show how the middle switch is unlatched as the main cover is closed;

FIG. 11A is a partial cross section view of one of the upper or lower switches to show how it is latched and unlatched;

FIG. 11B is a partial cross section view taken on the line 11B—11B of FIG. 11A to show how an electrical contact is made and/or broken in response to switch actuation;

FIG. 12A is a back view of the tamper cover;

FIG. 12B is a cross section side view of the tamper cover, taken on the line 12B—12B of FIG. 12A, showing how it pivots on the main cover and latches to the base;

FIG. 12C is a cross section view of the tamper cover, taken on the line 12C—12C of FIG. 12A, to show how it actuates the upper switch and breaks the upper break-rod;

FIG. 13 is a view of a break-rod;

FIG. 14 is a view of the terminal board for making connections; and

Figure 15:
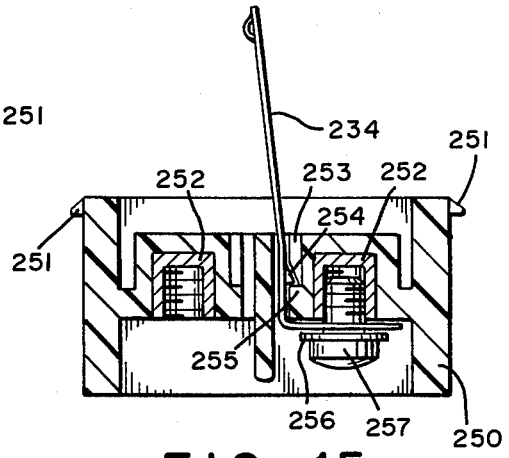

FIG. 15 is a cross section view of FIG. 14 taken on line 15—15 to show how the contacts are locked in position.

DESCRIPTION OF THE PREFERRED EMBODIMENTS

It is believed that the structure, its operation, functions, objectives, and features can be most easily perceived and understood by a brief review of the major components of typical fire alarm stations. It should be recalled that, for convenience, the various elements or components of the fire alarm station will be given numeric designators wherein the first digit indicates the major component of which the identified element may be a portion. More specifically, the first digit 1 through 4 relates to the base, switches, the main cover and the tamper cover, respectively, and the digit 5 relates to other miscellaneous elements.

Considering now more specifically FIGS. 1 and 2 which show front and side views, respectively, of a typical fire alarm signal station, there will be seen the base 100, typical switches 210, 220 and 230; the main cover 300 and the tamper cover 400. In addition, there may be seen a lower break-rod 501 and a portion of the terminal block 250.

The base 100 is seen in front view in FIG. 3; and the switch 230 may be more fully seen in FIG. 10. The back view of the terminal block 250 is seen in FIG. 14. The tamper cover 400 is more fully shown in FIGS. 12A, 12B, and 12C.

Although the various views of the fire alarm signal station show the tamper cover 400, it should be appreciated that not all fire alarm signal stations will be equipped with a tamper cover 400 and selected associated members may also be omitted from the main cover 300. In a similar fashion, some assemblies will not include the switches 210 and/or 230.

One or more of the switches 210, 220 and 230 are shown in somewhat more detail in FIGS. 8, 9, 10, 11A and 11B. Each switch will be seen to include a plunger cap, a plunger, and a wafer. FIGS. 11A and 11B illustrate the details of one of the switches 210 or 230. The switch as shown in FIGS. 11A and 11B includes the plunger cap 211, a plunger 212, and a wafer 213. As will be seen in FIG. 11A, the plunger cap 211 includes a keyhole 214 through which the shank 511 of key 510 may pass. The function of the key 510 and the other parts of the switches 210, 220 and/or 230 will be explained more fully herein below.

As is readily apparent from the various figures, the main cover 300 is pivotally coupled to the base 100. FIGS. 5A through 6B illustrate in detail the portions of the base 100 and the main cover 300 which cooperate to pivotally couple them together and will be explained more fully herein below. Also as is readily apparent, the tamper cover 400 is pivotally coupled to the main cover 300.

FIGS. 7A through 7C show the manner in which the main cover 300 is latched to the base 100 when the main cover is closed on the base. The details of the latch actuation will be explained more fully herein below.

It should be appreciated that most of the components of the fire alarm signal station are fabricated from a plastic material which possesses suitable characteristics. Typically, prior art fire alarm signal stations were fabricated of a cast metal. It should be understood at the outset that the fire alarm signal station of the present invention does not comprise a mere substitution of plastic for the prior art metal. More specifically, the characteristics and features of the selected plastic were utilized during the design to make them provide features and functions which were not available from prior art counterparts and/or which could have been provided only by greatly increasing the number of individual components. More specifically, as the following description proceeds it will be observed that the entire fire alarm signal station is assembled without requiring any rivets, screws, pins, fastening devices, and/or other elements which are typically used in assembly.

While there are numerous plastics that might be used, the selected material is an opaque polycarbonate plastic. Some of the characteristics of the selected material follow:

| | | |
|---|---|---|
| Density | 0.045 | pounds per inch cubed |
| Mold shrinkage | 0.005–0.007 | inches per inch |
| Long-term water absorption | 0.27% | |
| Tensile strength at yield | 9900 | pounds per inch square |
| Tensile strength at break | 9700 | pounds per inch square |
| Elongation at yield | 8% | |
| Elongation at break | 100% | |
| Tensile modulus | 340,000 | pounds per inch square |
| Compressive strength at yield | 11,000 | pounds per inch square |
| Izod impact strength (notched) ⅛ inch | 2.0 | foot pounds per inch |
| Izod impact strength (un-notched) ⅛ inch | greater than 60 | foot pounds per inch |
| Tensile impact strength (S specimen) ⅛ inch | 150 | foot pounds per inch squared |
| UL temperature index (⅛ inch specimen) | | |
| Electrical | 239 | degrees Fahrenheit |
| Mechanical with impact | 230 | degrees Fahrenheit |
| Mechanical without impact | 239 | degrees Fahrenheit |
| Rockwell hardness | 75 | M scale |
| Dielectric strength | over 15.7 | kV/mm |

As suggested, other suitable plastics could be selected; and depending on some of their properties and characteristics, selected dimensions might be changed. That is, it will be seen that the yielding characteristics of the selected material are incorporated in the design to provide various latches, springs and/or detents. With other materials, members might have to be thicker, thinner, longer, or shorter as required by the physical characteristics of the selected material and to meet the required strengths.

PIVOTING OF MAIN COVER TO BASE

From FIGS. 2, 5A, 5B, 6A, 6B, 8, 9, and 10, it will be seen that the main cover 300 is pivoted to the base 100. FIG. 3 illustrates a front view of the base 100 as seen without the main cover 300. There is also included the plunger caps 211 for the switches 210 and 220, respectively. A plug 215 is used when the switch 210 and/or 230 is not used. The base 100 includes mounting hole 101 and mounting slot 102. The mounting hole 101 and mounting slot 102 facilitate mounting of the fire alarm signal station in a standard wall box and permit positioning to adjust the fire alarm signal station vertically. The base 100 includes a left side support 110 and a right side support 120 which include hinge pockets 111 and 121, respectively. Leading from the side support into the hinge pockets are entrance cams 112 and 122 on the left and right sides, respectively, of the base 100. The elements for the left side support 110, hinge pocket 111 and entrance cam 112 are shown in enlarged detail in FIGS. 5A and 5B wherein FIG. 5B is a cross-section view taken along the plane 5B—5B of FIG. 5A. Thus, as may be seen in FIGS. 5A and 5B, the hinge pocket 111 comprises a well in the left side support 110 of the base 100. These elements may also be seen in FIGS. 4A and 4B although these figures are included to more fully illustrate another feature of the invention. The main cover 300 includes a lower end 301, see FIGS. 1 and 2. An enlarged view of the right side of the lower end 301 of the main cover 300 is illustrated in FIGS. 6A and 6B, wherein FIG. 6B is a view as seen from the plane 6B—6B of FIG. 6A. As may be seen in FIG. 6A, the lower end 301 includes as an integral part thereof a hinge pin 302. It should be understood that the hinge pin 302 is fabricated and cast of the same plastic material of which the entire cover 300 is made. It will be appreciated that at both the left and right ends of the lower end 301 of the main cover 300 there is a hinge pin 302 and that the cover 300 may be assembled to the base 100 by inserting one of the hinge pins 302 into the appropriate hinge pocket 111 or 121 and guiding the other hinge pin 302 into the appropriate entrance cam 112 or 122 and applying mild pressure which will result in slight yielding of at least one of the side supports 110 and 120 until the second hinge pin 302 is seated in its associated hinge pocket. After both hinge pins 302 are seated in their associated hinge pockets 111 and 121 the left and/or right side supports 110 and 120 restore to their normal position and the main cover 300 is securely and pivotally coupled to the base 100. Accordingly, as will be readily appreciated, the cover 300 is pivotally coupled to the base 100 without the need for any auxiliary parts.

LATCHING OF MAIN COVER TO BASE

As will be more fully appreciated as the description proceeds, an alarm signal is initiated in response to pivoting the cover 300 from its closed position to an open position. It will be evident that the main cover 300 should not be latched so securely to the base 100 that it requires an extraordinary force to open it and originate the alarm. But conversely, the cover should not open so readily that it might accidentally or inadvertently open in response to being bumped or jarred. One standard for assuring that a signal station meets an appropriate compromise between these two requirements states that a signaling box shall be capable of withstanding jarring resulting from impact and vibration such as might be experienced in service without causing signaling operation of any part and without adversely affecting its subsequent normal operation. In this particular test, the effects of jarring are to be determined by supporting the box in the position of intended use to the center of a 6'×4' ¾" thick plywood board which is secured in place at four corners. A three foot-pound impact is to be applied to the center of the reverse side of the board. This impact is to be applied by means of a 1.18 pound, 2" diameter steel sphere swung through a pendulum arc from a sufficient height to apply three foot-pounds of energy.

With the dimensions and geometry of the present signaling box, it was determined that it should be possible to open the cover 300 with the application of a force no greater than 7 pounds when the main cover 300 is pulled when grasped at the area 303 illustrated in FIGS. 10, 12B, and 12C. The latch that satisfied these stringent requirements is more fully shown in FIGS. 7A, 7B, and 7C. As may be seen in FIGS. 2 and 3, the base 100 may be seen to include part of a latching mechanism 103 on both the left and right hand sides thereof. Appropriate mating elements are included in the cover 300. These elements are more fully seen in FIGS. 7A, 7B, and 7C. Considering now more specifically FIG. 7A, there will be seen a cross section view of a portion of the base 100 and the cover 300 when they are in the closed or latched position. As may be seen, the base 100 includes a latch 103 and a notch 104. In a similar manner, the cover 300 will be seen to include a notch 304 and a latch 305. When the signaling box is closed, the latch 305 of the cover 300 is in the notch 104 of the base 100 and concurrently the latch 103 of the base is in the notch 304 of the cover. In response to either an inadvertent jarring or a direct pull at the pull point 303 (see FIG. 10, 12B, or 12C), the cover and base will have relative motion and be in the position as illustrated in FIG. 7B. In order to permit this position, the sides 306 (see FIG. 2) will be bowed slightly outward. Because of the material of which the cover 300 is made, its sides 306 will yield as the cover 300 is pulled to the position illustrated in FIG. 7B. At this time the sides 306 of the cover 300 serve effectively as a spring and if the cover is released the latch 305 of the cover will be cammed down the slope of the latch 103 so that the latch 305 will be restored to the notch 104. Accordingly, it will be appreciated that if the fire alarm signal station is subjected to a jarring blow the cover 300 may pivot a few degrees from its closed position but continued movement thereof requires additional flexing and separation of the sides 306 of the cover 300 and if the motion of the cover was initiated in response to a jarring action, the energy will be absorbed by the yielding of the sides 306 of the cover 300 and the latch 305 will not pass the peak of the latch 103 and therefore the cover 300 will return to its latched position as illustrated in FIG. 7A. However, if a constant 7 pound force is applied at the pull point 303, the sides 306 of the cover 300 will continue to separate and the latch 305 will pass over the peak of the latch 103. At this point with the latch 305 past the peak of the latch 103, the sides 306 of the cover 300 will begin to restore to their normal position and substantially no additional force will be required at the pull point 303 to pivot the cover 300 to its open position.

From the above, it will be appreciated that the cover 300 and base 100 both include a notch and latch which will inhibit opening in response to jarring action but which will not require an excessive pull to open the cover when required. It will also be appreciated that the latch 103 has ramps 105 and 106 and that during opening the ramp 105 requires yielding of the sides 306 of the cover 300 thereby dissipating force resulting from a jarring blow and which would provide a camming action to assist in restoration of the cover 300 to a normal position subsequent to a jarring blow that jarred the cover 300 to the position shown in FIG. 7B. The ramp 106 helps to open the cover 300 in response to a pull at the pull point 303 and also helps to separate the sides 306 of the cover when the cover is being closed.

As may be seen in FIG. 3, the latching mechanism illustrated more fully in FIGS. 7A to 7C is located at approximately the midpoint of the base 100 and the cover 300. However, it will be obvious that the latching mechanism could be moved upward or downward and that such repositioning of the latching mechanism, without any other changes of dimensions, would tend to alter the force required to open the cover in response to either a jarring action and/or a pulling action at the pull point 303. Accordingly, the jarring force that will be resisted and the pull force that will be required to open the cover may be controlled by a combination of factors including the selection of the material of which the base and cover are made and the form required to make them yield; the depth of the notches 104 and 304; and the height and angle of the ramps 105 and/or 106 and the position of the latch 103 relative to the top and bottom of the base 100. It should also be observed that the initial movement of the cover includes a camming action as the ramp 307 slides on the junction point 107 between the notch 104 and the ramp 105.

INSERTION OF LOWER BREAK-ROD

It has become traditional in fire alarm signaling stations to provide some sort of psychological impediment to the origination of false signals. This psychological impediment has traditionally taken the form of either a small glass window or a glass rod, either of which must be broken prior to the actuation of the mechanism for the origination of a fire alarm signal. The act of physically breaking a component is believed to serve as a deterrent to the origination of false alarms. The structure of the present invention includes such a psychological deterrent in the form of a lower break-rod 501 which may be seen in FIG. 1 and which is shown in more complete detail in FIG. 13. The cover 300 includes a rectangular hole 310 through which the break-rod 501 may be viewed when the fire alarm signal station is in its normal closed position.

As the following description proceeds, it will be seen that the lower break-rod 501 is mounted on the base 100 and that it is cammed aside as the cover 300 is closed and that a subsequent opening of the cover 300 will result in the breaking of the lower break-rod 501. The break-rod 501 may be fabricated of glass or a suitable plastic. If plastic is used, a transparent plastic would probably be selected to simulate glass inasmuch as the public has grown accustomed to the use of glass. The use of a plastic break-rod has some advantages over glass in that they are slightly less fragile, and more importantly, a plastic break-rod is less inclined to splinter or shatter when it is broken and splintering or shattering glass could accidently and inadvertently cause a minor cut to the person activating the alarm.

The technique for inserting the lower break-rod 501 will be more fully understood as the following description is perused in connection with FIGS. 3 and 4A through 4E.

Considering first FIG. 3 and the front view of the base 100, there will be seen at the lower end thereof left and right break-rod containment springs 126 and 127, respectively. These break-rod containment springs will be seen to comprise an integral part of the base 100 and it will be noted that they are cantilevered from the base by the formation of the slots 128 and 129. Accordingly, it is easy for the containment springs 126 and 127 to yield in response to downward pressure on the ends 130 and 131. The base 100 also includes a left and right break-rod retaining hook 132 and 133, respectively.

FIGS. 4A through 4E comprise an enlarged view of a portion of the base 100 including the elements cited hereinabove and FIGS. 4C through 4E also include a portion of the main cover 300 showing its interaction with the break-rod 501. More specifically, FIGS. 4A through 4E selected parts that are seen have a symmetrical counter part. In some views, portions of elements are broken away to show the symmetrical counterpart. Considering first FIG. 4A, it will be seen that it shows an enlarged cross section view of the left break-rod retaining hook 132 together with the upstanding portion 131 of the right break-rod containment spring 127. As previously mentioned, the break-rod containment springs 126 and 127 are an integral part of the base 100 and are supported by a cantilever so that, as may be seen in FIG. 4B, the containment spring 127 may be moved to the right, as viewed in FIGS. 4A to 4E, with respect to the break-rod retaining hook 132. To emphasize the movement of the containment springs 127, it is shown in FIGS. 4B and 4D as extending to the right of the right limit of the base 100. Because of mounting requirements, design constraints would usually be imposed to prevent containment spring motion of the magnitude illustrated.

To position the break-rod 501 so that it will be retained by the retaining hooks 132 and 133 and the containment springs 126 and 127, the break-rod 501 is first placed on the leading edge 134 of the containment springs 126 and 127 to the position illustrated in FIG. 4B thereby allowing the break-rod 501 to enter under the hood end 138 of the retaining hooks 132 and 133. After the break-rod 510 has been pushed past the hood end 138 of the retaining hook 132, the spring pressure of the containment spring 126 and 127 will urge the break-rod 501 into the hood end 138 of the break-rod retaining hooks 132 and 133 which is complementarily shaped with the break-rod 501 to form a pocket for retaining the break-rod. This position as illustrated in FIG. 4C and the spring action of the containment springs 126 and 127 urges the break-rod 501 into the complementary shape of the retaining hook 132. It should be appreciated that similar action takes place at both the left and right hand ends of the break-rod 501. In addition, the left and right break-rod retaining hooks 132 and 133, respectively, have closed ends to inhibit excessive lateral movement of the break-rod 501.

Consideration will now be given to the manner in which the break-rod 501 is cammed aside during the closure of the main cover 300 and the manner in which the break-rod is broken in response to the opening of the main cover 300 after it has been closed.

FIGS. 4C through 4E are similar to FIGS. 4A and 4B but include a part of the main cover which interacts with the break-rod 501. More specifically, an enlarged view of part of the lower portion of the main cover 300 is shown in cross section. Note that this includes the area of the hinge pin 302 and the associated hinge pocket 111. The main cover 300 includes an internal striker bar 312 and associated stress concentrator 314 molded as an integral part of the cover 300 and situated just below the hole 310 and having a width which is less than the width between the ends 130 and 131 of the left and right break-rod containment springs 126 and 127, respectively. The striker bar 312 includes a cam portion 313 which engages the break-rod 501, as illustrated in FIG. 4C, and urges it up and to the right as illustrated in FIGS. 4C and 4D, so that it is urged by the cam portion 313 and guided by the cam 135 of the retaining hook 132. Just after the time illustrated in FIG. 4D when the cover 300 has pivoted a few degrees further towards the closed position, the break-rod 501 will move down and to the left, as viewed in FIGS. 4D and 4E, under the urging of the break-rod containment springs 126 and 127 thereby situating the break-rod 501 in the hood end 138 of the retaining hooks 132 and 133. This results in the positioning of the parts as viewed in FIG. 4E which illustrates the cover 300 as being fully closed. In this position, the stress concentrator 314 is to the right of the break-rod 501 as viewed in FIG. 4E. Normally a spacing is provided between the stress concentrator 314 and the break-rod 501 so that there is no chance of fracturing the break-rod 501 in response to only a few degrees of motion of the cover 300. That is, the cover may move a few degrees in response to a blow or vibration and the break-rod should not break under such conditions. Also with space allowed the manufacturing tolerances are reduced.

The stress concentrator 314 comprises an integral part of the striker bar 312 but is preferably much shorter than the striker bar 312. That is, the stress concentrator 314 contacts the break-rod 501 in a narrow band at approximately its midpoint.

It should be appreciated that in the normal position of the fire alarm signal station with the main cover 300 closed and the break-rod 501 in position, the break-rod ends are supported under the hood ends 138 of the respective left and right retaining hooks 132 and 133, respectively, and urged into that position by the left and right containment springs 126 and 127, respectively. At this time, the stress concentrator 314 is positioned behind the break-rod 501 and therefore in response to a pivoting motion of the main cover 300 to move it more than a few degrees towards an open position, the stress concentrator 314 will act on the central portion of the break-rod 501 urging it to the left, as viewed in FIG. 4E. However, because the break-rod 501 is supported at its left and right ends by the retaining hooks 132 and 133 and break-rod cannot move except at its midpoint by fracturing. Accordingly, when the cover 300 is opened, the break-rod 501 is broken as illustrated in FIG. 9.

In order to facilitate breakage of the break-rod 501, it may be scored at its midpoint as indicated by 502 in FIG. 13. The break-rod 501 may include additional scoring 501 for purposes to be explained more fully hereinbelow.

To reset the fire alarm signal station, the broken break-rod 501 may be easily removed and a new break-rod inserted in the manner described hereinabove.

THE TAMPER COVER

As already mentioned, the lower break-rod 501 is used to provide a psychological deterrent to the initiation of a false alarm. It has been found that in certain locations it is desirable to provide an alternate or additional psychological deterrent to the initiation of false alarms. The structure of the present invention may include a tamper cover 500 pivotally coupled to the main cover 300. In addition, an upper break-rod 505 may be associated with the tamper cover 400 so that opening the tamper cover will break a break-rod. As an additional feature, the tamper cover may be used to actuate an auxiliary switch which can sound a local alarm to discourage any further meddling with the fire alarm signal station if there is not an actual emergency condition.

The tamper cover 400 may be seen in FIGS. 1, 2, 8, 9, 10, and 12A through 12C. When the tamper cover 400 is used, the main cover 300 will include side supports 325 similar to the side supports 110 and 120 used on the base 100 for pivotally mounting and supporting the main cover 300. The side supports 325 are most clearly seen in FIG. 1. It should be appreciated that the tamper cover 400 is mounted on the main cover 300 in substantially the same manner that the main cover 300 is mounted on the base 100 and as more fully illustrated in connection with FIGS. 5A, 5B, 6A, and 6B. Inasmuch as the method of mounting includes hinge pockets and entrance cams all as more fully described with respect to the main cover, it is believed that no further description is necessary to understand the manner in which the tamper cover 400 is pivotally supported and mounted on the main cover 300. However, it should be observed that in structures which do not include the tamper cover 400, the main cover 300 would not include the side supports 235 and/or some other elements to be discussed herein with respect to the tamper cover 400. That is, when the tamper cover 400 is not used, the main cover 300 is substantially planar above the position of the keyhole 320.

The tamper cover 400 includes hinge pins 402 which servie substantially the same function as the hinge pins 302.

The tamper cover 400 may be fabricated of transparent material if it is desired to permit a designation on the main cover 300 to be read through the transparent tamper cover 400.

An upper break-rod 505, not illustrated in FIGS. 1 or 2, but shown in FIGS. 8 and 9 may be associated with the tamper cover 400. This break-rod 505 is identical to the lower break-rod 501. As may be most clearly seen in FIGS. 8 and 9, the tamper cover 400 includes a pull point 403 to provide a means of conveniently grasping the tamper cover 400 and pivoting it away from the main cover 300.

The tamper cover 400 includes a double cam 410 molded as an integral part of the tamper cover 400. As may be most clearly seen in FIG. 1, the double cam 410 is relatively narrow and centered near the bottom of the tamper cover 400. The outer cam surface 411 (see FIG. 8) will serve to break the upper break rod 505. This is most clearly illustrated in FIGS. 8 and 9. The inner cam surface 412 will serve to actuate switch 210 for a function to be described more fully hereinafter. In addition to the double cam 410, the tamper cover 400 includes two hooks 420 with one located on each side of the double cam 410 as most clearly seen in FIG. 1. The shape of the hooks 420 may be more clearly seen in FIG. 9. As may be most clearly seen in FIGS. 3 and 9, the base 100 also includes a pair of hooks 140 which are situated to mate with the tamper cover hooks 420 when both the tamper cover and the main cover are closed as shown in FIG. 8. FIG. 3 also illustrates the hooks 140 of the base 100. To facilitate molding the hooks 140 of the base 100, a hole 141 is included in the base 100. When the tamper cover and main cover are closed as illustrated in FIG. 8, the hooks 140 and 420 latch and thereby prevent any possibility of grasping the main cover and disengaging its latch (FIGS. 7A through 7C) without first having pivoted the tamper cover 400 away from the main cover 300.

A keyhole 413 is included in the double cam element 410 for a function to be described more fully hereinbelow (see FIGS. 1 and 8).

The upper break-rod 505 is mounted on the side supports 325 in a more traditional manner than that by which the lower break-rod 501 is mounted. More specifically, one of the side supports 325 has a through hole 326, see FIG. 10, through which the upper break-rod 505 may be passed towards the other side support 325 thereby supporting the two ends of the upper break-rod 505 in the two side supports 325.

In order to inhibit unauthorized removal of the upper break-rod 505 by sideways longitudinal motion through the hole 326 of the side support 325, a detent 327 comprises a cantilever spring integrally molded as part of the main cover 300 for engaging one of the notches 503 of the upper break-rod 505 which is identical to the lower break-rod 501 shown in FIG. 13. Accordingly, the detent 327 engages the notch 503 and inhibits any lateral motion of the break-rod 505 and since the break-rod 505 covers the detent 327, it is very difficult to release the detent 327 to remove the break-rod. This is designed to prevent tampering or removal of the upper break-rod 505. It will be obvious that if desired, a second detent (not shown) could be located near the other side support 325 thereby making a symmetrical arrangement. Because of the notch 502 in the upper break-rod 505 and because the inner cam surface 412 acts on the upper break-rod at the midpoint, it is sure to break at the point 502. With the upper break-rod made of plastic material, the probability of any chips or sharp edges forming is reduced, thereby reducing the probability of anyone being inadvertently cut as might happen if the upper break-rod were made of glass.

THE UPPER AND LOWER SWITCHES

The fire alarm signal station may include up to three switches. Switch No. 220 in the central position is always included. However, this section will discuss switches 210 and 230 which may be optionally included to provide othere features. As will be shown, the switches 210 and 230 will latch when they are depressed and remain latched until such time as they are released by a special key 510. In the normal operation of the system, the switches 210 and 230, when used, are unlatched and latched respectively, in the standby or armed mode wherein the main cover 300 is closed. The upper switch 210 will be mechanically operated and latched in response to operation of the tamper cover 400. The lower switch 230 will be released under selected conditions and under key control only after the main cover 300 has been opened.

Except for the circumstances under which the switches 210 and 230 are actuated and/or released, their operation is identical; and therefore, the following discussion will relate to switch 210; but it should be understood that an identical description with respect to the components would describe switch 230.

The switch 210 is shown in its unlatched position in FIG. 8 and in its latched position in FIG. 9. Switch 230 is shown latched and unlatched in FIGS. 8 and 9, respectively. FIGS. 10, 11A, and 11B should also be examined during the following description. As may be seen in FIG. 11A, the principal components of the switch 210 includes the plunger cap 211, the plunger 212, and the wafer 213. Actually, the wafer 213 and the plunger 212 are an integral molding comprising a single part. As may be most clearly seen in FIG. 11B, the plunger cap 211 may be coupled to the plunger by pressing the plunger cap 211 onto the plunger 212 with an appropriate orientation so that the shoulder 216 of the plunger 212 enters the complementary shaped cavity 217 in the plunger cap 211. During assembly, there is a minor deflection of the plunger cap and/or plunger so that the latch 218 will catch on the shoulder 219 of the plunger cap 211 to retain the plunger cap 211 and the plunger as a united assembly. As is best seen in FIGS. 11A and 11B, the plunger 212 includes a guide pad 231 which will serve a function to be described more fully hereinbelow. In addition, the plunger 212 includes the shoulder lock 232 which, as may be seen in FIG. 11A, serves to latch the switch 210 in its locked position.

As may be seen in FIGS. 2, 8, 9, and 10, each of the switches includes a compression spring 233 which will attempt to move the plunger 212 and the plunger cap 211 to the left as viewed in these figures when the latch is released. As is most clearly seen in FIGS. 8, 9, 11A, and 11B, contact fingers 234 are associated with the wafers 213. As may be readily visualized from FIG. 11A, the plunger 212 and wafer 213 are symmetrical and may be assembled as illustrated in FIG. 11A, or the plunger and wafer could be rotated 180 degrees about its longitudinal axis and assembled in that position. The only difference resides in the wafer 213 wherein the wafer includes two contact windows 235, one of which is at the lower end of one side of the wafer and the other of which is at the upper end of the other side of the wafer. For example, as viewed in FIG. 11A, the upper portion of the wafer 213 includes a contact window on the right hand half while the lower half of the wafer 213 includes a contact window 235 on the left hand side. By rotating the plunger and wafer combination about its longitudinal axis during assembly, it is possible to selectively assemble the switch 210 to provide either a normally open or a normally closed contact. As illustrated in FIGS. 11A and 11B, the contact fingers 234 are held apart by a barrier 236 when the plunger is latched. It can readily be visualized from FIG. 11B that if the plunger moves to the left in response to the action of the spring 233, the contacts 234 will, by spring action, flex towards each other and make contact through the contact window 235. The contact arms 234 are supported by a contact block to be described more fully hereinafter (see FIGS. 14 and 15).

It is of course understood that the base 100 includes a hole 115 which is suitably shaped to complement the shape of the plunger 212 to provide guidance and support as it moves reciprocally between its latched and unlatched positions. In addition, as may be most clearly seen in FIGS. 8, 9, and 11A, the base 100 includes, as an integral part thereof, a flexing cantilever latch 116 which is biased towards contact with the plunger 212. In response to actuation of the switch 210 by pushing on the plunger cap 211 either manually or by the inner cam surface 412 or the double cam 410, the cantilever flexing latch 116 will ride along the cam surface 237 (see FIG. 11A) and fall into the shoulder lock 232, thereby latching the switch as shown in FIG. 11A. When it is desired to release this switch 210, the key shank 511 of key 510 may be inserted in keyhole 214 of plunger cap 211 by which it is guided along the guide pad 231 to apply pressure against the flexing cantilever latch 116 to cause it to be disengaged from the shoulder lock 232 whereupon the spring 233 acting on the underside of the plunger cap 211 will move the plunger cap, plunger, and wafer to the left as viewed in FIG. 11A. In response to movement of the plunger 212 and associated wafer 213 either a contact window 235 or a barrier 236 is aligned with the contacts 234. Therefore, in response to the movement of the wafer from one limit to the other limit, the contacts are changed from open to closed or from closed to open. It should be understood that the contacts 234 remain stationary except for the small motion against their spring bias as the barrier 236 is moved to or from the position between the contacts.

Considering now more specifically the switch 210 comprising the uppermost switch in the assembly and specifically the switch which is actuated in response to the pivotal motion of the tamper cover 400, it may be observed that if this switch has been actuated in response to the pivoting action of the tamper cover 400 and by the inner cam surface 412 acting the the plunger cap 211, the switch 210 may be restored to its unlatched position without opening the main cover 300. More specifically, when the main and auxiliary covers are closed as illustrated in FIG. 8, it will be seen that there is a keyhole 413 through the double cam 410 and the key 510 may have its shank end 511 inserted through the keyhole 413 of the double cam 410 and then through the keyhole 214 of the plunger cap 211 to release the switch 210 in the manner more fully illustrated in FIG. 11A and described in connection therewith. When the switch 210 is in the unlatched position and the covers are closed as shown in FIG. 8, the spring 233 will bear on the underside of plunger cap 211 and cause it to come in contact with inner cam surface 412. This provides a spring bias to maintain the tamper cover 400 in its closed position as illustrated in FIG. 8.

Considering now more specifically switch 230, it may readily be envisioned that the cap 211 and/or the cover 300 may be proportioned for mutual cooperation so that in response to the closure of the cover 300, the switch 230 will be moved to its latched position. Or in the alternative, if it is desired not to have the switch 230 latched in response to closing the cover 300, such actuation may be achieved by appropriate spacing between the cover 300 and the cap 211 as to prevent latching. FIG. 8 illustrates this latter case.

THE CENTER OR ALARM SWITCH

The center switch comprising switch 220 as seen in FIGS. 8 and 9 differs from the switches 210 and 230 primarily in that it is latched in the out position while the upper and lower switches 210 and 230 are latched in the in position. This different feature requires a slightly different plunger 241 which differs from plunger 212 in that it does not include the guide pad 231, the shoulder lock 232, or the cam surface 237. For the center switch 220, the base 110 includes a shoulder lock 136 and the middle plunger 241 includes a flexing cantilever latch 242. It should be understood that the flexing cantilever latch 242 is molded as an integral part of the middle plunger 241 and that when the middle plunger 241 moves to the left under the action of the spring 233, the flexing cantilever latch 242 will be caught and held by the shoulder lock 136 thereby preventing depressing the switch 220 by pushing the associated plunger cap. The switch 220 will remain in the latched position until such time as it is released by insertion of the key shank 511 into the keyhole 214 of the switch 220.

As may be seen in FIG. 8, the switch 220 is held in the unlatched position when the main cover 300 is closed. The associated spring 233 urges switch 220 towards the unlatched position, but it is restrained from moving to the unlatched position by stop 318 which comprises an integral part of the cover 300 and which has appropriate dimensions to hold the switch 220 in the unlatched position while the cover 300 is closed. The force of spring 233 bearing indirectly on the stop 318 is insufficient to push the cover 300 open against the force of the latch shown and described with respect to FIGS. 7A through 7C. However, as soon as the cover 300 is opened, the spring 233 associated with switch 220 will move switch 220 to its latched position; and it will be impossible to depress it without the use of the key 510; and without switch 220 depressed, the cover 300 cannot be reclosed to the latched position.

In order to close the cover 300 to the latched position, the cover is first raised to the point where the stop 318 first contacts the plunger cap 211 of switch 220. Thereupon the key shank 511 of key 510 may be inserted through the keyhole 320 which is aligned with the keyhole 214 of the plunger cap 211 of switch 220. The key 511 is guided by these two keyholes and the guide pad 137 of the base 100 to deflect the flexing cantilever latch 242 away from the shoulder lock 136 and thereby unlatch the switch 220. At this time, the cover 300 is pushed further towards its latched position; and the stop 318 acting on the plunger cap 211 of switch 220 will move it to its unlatched and armed position as illustrated in FIG. 8. Note that in armed or standby position with cover 300 closed any switches which are controlled by the key 510 are in the released position and therefore use of an unauthorized key cannot alter the desired standby position of any switch.

THE TERMINAL BLOCK

The terminal block 250 will be seen to support the contacts 234; and in turn, it is supported by wall members 150. These members are most clearly seen in FIGS. 2, 8, 9, 10, 14, and 15.

The wall members 150 comprise an integral part of the base 100 and include four walls having an opening configured to accept and be complimentary to the outline of the terminal block 250 as seen in FIG. 14. Included in the wall members 150 are latching holes 151 into which catch members 251 will fit. Thus, the terminal block 250 may be supported and accurately aligned with the base 100 by pressing the terminal block 250 into the opening formed by the walls 150 until the catch members 251 enter the latching holes 151. The various members yield sufficiently to allow the insertion of the terminal block 250 and its subsequent latching. Positioned in each of the four corners of the wall members 150 are stops 152, which serve to limit the depth to which the terminal block 250 may be inserted.

As may be seen, in FIG. 15, the terminal block 250 includes a plurality of press-fitted threaded inserts 252 and holes 253. Formed metallic contact springs 234 are inserted through the holes 253 and held thereon by a latch member 254 formed in the spring 234 which engages a shoulder 255 forming a part of the terminal block 250. This secures the contact terminal 234 in position. Similar contact terminals 234 may be inserted through any or all of the holes 253. Normally, contacts 234 are inserted in mating holes so that pairs of contacts may make contact with each other. A pressure pad 256 having a screw 257 is placed on the lower end of the contact terminal as seen in FIG. 15 through a central hole in the pressure pad 256 and the contact 234 so the screw 257 engages with the threaded insert 252. When the fire alarm signal station is wired in the field, appropriate wires are placed between the pressure pad 256 and the lower end of terminal 234. The pressure pad may include serrations to improve wire retention and may have bent down, as viewed in FIG. 15, corners to facilitate proper wire entry through holes 258.

It will be seen that if contacts 234 are placed through the uppermost pair of holes 253 in the terminal block 250, as seen in FIG. 14, these contacts will be actuated by the wafer 213 associated with the upper switch 210. The contacts 234 associated with the upper switch 210 will be either normally opened or normally closed, depending upon the selected orientation of the wafer 213 of the upper switch 210 at the time it was assembled. That is, as set forth with respect to the discussion of the upper and lower switches, the wafer 213 is fabricated with a contact window 235 in a lower position on one half of the wafer and in an upper position on the other half of the wafer. Accordingly, by selective orientation of the wafer, the contacts 234 of the upper switch 210 may be caused to be either open or closed, as may be desired, when the switch is in the latched position. Contacts 234 placed through the lowermost pair of holes 253 as seen in FIG. 14 will operate in a similar manner with the wafer 213 of the lower switch 230. And in a similar manner, the lower switch 230 may be made to be either a normally-open or normally-closed contact depending upon the orientation given to the associated wafer 213 during assembly.

The center switch 220 may be associated with two pairs of contacts, although only one pair is illustrated in FIGS. 8 and 9. That is, contacts 234 may be inserted through all four holes 253 in the center of the block 250 as viewed in FIG. 14. Each of the pair of contacts 234 will function with one half of the wafer associated with the center switch 220. The wafer for the center switch 220 may be fabricated with contact windows 235 in either the upper or lower positions and different wafer and plunger assemblies used to provide a switch 220 which may have any combination of normally-open and normally-closed contacts.

As shown in FIG. 10, the terminal block 250 may include wiring holes 258 through which wires may be inserted under the pressure pads 256 for clamping action by tightening the screw 257. The terminal block 250 includes appropriate insulating barriers 259.

SUMMARY

In summary, there has been shown and described a simple, convenient, and economical fire alarm signal station which may be readily assembled and which uses a minimum number of parts. The structure is made of an appropriate plastic having characteristics which provide appropriate yield and spring action. Various elements and components may be included or omitted as required by various applications.

While there has been shown and described what is considered at present to be a preferred embodiment of the invention, modifications thereto will readily occur to those skilled in the related arts. For example, in another structure all switches could be provided with multiple contacts, or pull handles could be provided or the release tool could have a more sophisticated configuration to inhibit use of unauthorized tools. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiment shown and described, and it is intended to cover in the appended claims all such modifications as fall within the true spirit and scope of the invention.

We claim:

1. A unitary base for a fire alarm box to be equipped with a break-rod and comprising in combination:

(a) a base fabricated of a material capable of at least some yield, without fracture, in response to an applied force;

(b) said base including first and second break-rod support posts with each break-rod support post having an associated rod pocket;

(c) said base including, as integral members thereof, first and second break-rod containment springs juxtaposed proximate to said rod pockets of said first and second posts, respectively, for retaining a break-rod in a predetermined position after it has been positioned in said rod pockets; and wherein (d) said first and second rod pockets and the respective associated break-rod containment springs are contoured and positioned in cooperative relationship with each other and an associated break-rod for permitting at least some movement of the break-rod in one direction from said predetermined position and for inhibiting movement from said predetermined position in a direction opposite to said one direction.

2. The combination as set forth in claim 1 wherein as said break-rod moves to and from said predetermined position, the longitudinal axis of the break-rod does not stray substantially from a position parallel to the position thereof when said break-rod is in said predetermined position.

3. The combination as set forth in claim 2 wherein said rod pockets cooperate with the break-rod for limiting longitudinal movement of the break-rod.

4. The combination as set forth in claim 1 and including a cover selectively hinged to said base.

5. The combination as set forth in claim 4 wherein said cover includes a cam element cooperating with a break-rod in said predetermined position for moving said break-rod in said one direction in response to pivotal movement of said cover in a first direction.

6. The combination as set forth in claim 5 wherein said cam on said cover includes a stress concentrator portion for urging movement of said break-rod in the direction opposite to said one direction in response to pivotal movement of said cover in a direction reverse to said first direction whereby said break-rod is ruptured.

7. The combination as set forth in claim 6 wherein said break-rod includes circumferential scoring intermediate of its ends whereby when it is ruptured it is ruptured at the point of circumferential scoring.

8. The combination as set forth in claim 7 wherein said break-rod, when ruptured, forms first and second portions and wherein said first and second break-rod containment springs apply a force for retaining said first and second portions in said first and second rod pockets, respectively.

9. The combination as set forth in claim 4 wherein said base and said cover include cooperating elements for retaining said cover in a closed position.

10. The combination as set forth in claim 9 wherein said cooperating elements comprise a cam relationship for causing yielding of said cover and/or said base in response to pivotal movement of said cover from an open to a closed position or from a closed to an open position.

11. The combination as set forth in claim 10 wherein the cam relationship of said cooperating elements serves to restore said cover to a closed position if said cover is pivoted not more than a predetermined amount from said closed position and released.

12. The combination as set forth in claim 11 and including a spring biased switch mounted on said base which is restrained in a first position while said cover is in a closed position and which, in response to said cover being pivoted to an open position, is moved by said bias spring to a second position.

13. The combination as set forth in claim 12 and including latching means for inhibiting movement of said switch from said second position to said first position.

14. The combination as set forth in claim 13 and including release means for selectively releasing said latching means to permit movement of said switch from said second position to said first position while said cover is in a nearly closed position.

15. The combination as set forth in claim 14 wherein said release means comprises:

(a) an opening in said cover; and (b) an aligned opening in said switch; and wherein (c) with both said openings aligned with said latching means a tool may be inserted through said openings for selective release of said latching means.

16. A cover for a fire alarm box comprising in combination:

(a) a unitary cover fabricated of a material capable of at least some yield, without rupture, in response to an applied force;

(b) first and second break-rod support posts forming an integral part of said cover; and (c) a cantilever break-rod retaining spring forming an integral part of said cover and positioned for cooperation with a break-rod supported by said first and second support posts.

17. The combination as set forth in claim 16 wherein said retaining spring includes a detent member for engagement with a circumferentially scored notch on a break-rod supported by said posts whereby longitudinal motion of a break-rod supported by said support posts is inhibited while said detent is so engaged.

18. The combination as set forth in claim 17 and including an auxiliary cover coupled to said unitary cover for pivotal motion with respect thereto.

19. The combination as set forth in claim 18 and including a cam member on said auxiliary cover positioned and contoured for rupturing a break-rod supported by said support posts in response to said auxiliary cover being pivoted from a first position to a second position.

20. The combination as set forth in claim 18 wherein said first and second break-rod support posts include first and second hinge pockets, respectively, for pivotally supporting said auxiliary cover.

21. The combination as set forth in claim 20 wherein at least one of said first and second support posts includes a cam surface leading into its associated hinge pocket for guiding a hinge pin of said auxiliary cover into said associated pocket.

22. The combination as set forth in claim 21 wherein at least one of said first and second support posts yields sufficiently in response to force applied to said cam surface to admit a hinge pin of said auxiliary cover into said associated pocket and then capture same.

23. The combination as set forth in claim 22 and including a unitary base on which said cover is pivotally coupled.

24. The combination as set forth in claim 23 wherein said base includes a pair of support posts and said cover is coupled to said base in a manner substantially identical to that by which said auxiliary cover is coupled to said cover.

25. The combination as set forth in claim 24 wherein said unitary base is fabricated of material similar to that used for the fabrication of said unitary cover and wherein said base includes as an integral part:

(a) first and second break-rod support posts with each break-rod support post having an associated rod pocket;

(b) first and second break-rod containment springs juxtaposed proximate to said rod pockets of said first and second posts, respectively, for retaining a break-rod in a predetermined position after it has been positioned in said rod pockets; said first and second rod pockets and the respective associated break-rod containment springs are contoured and positioned in cooperative relationship with each other and an associated break-rod for permitting at least a limited range of movement of the break-rod in one direction from said predetermined position and for inhibiting movement from said predetermined position in a direction opposite to said one direction.

26. The combination as set forth in claim 25 wherein as said break-rod moves within said limited range the longitudinal axis of the break-rod does not stray substantially from a position parallel to the position thereof when said break-rod is in said predetermined position.

27. The combination as set forth in claim 26 wherein said cover includes a cam element cooperating with a break-rod in said predetermined position for moving said break-rod in said one direction in response to pivotal movement of said cover in a first direction.

28. The combination as set forth in claim 27 wherein said cover includes a stress concentrator portion for urging movement of said break-rod in the direction opposite to said one direction in response to pivotal movement of said cover in a direction reverse to said first direction whereby said break-rod is ruptured.

29. The combination as set forth in claim 28 wherein said break-rod includes circumferential scoring intermediate of its ends whereby when it is ruptured it is ruptured at the point of circumferential scoring.

30. The combination as set forth in claim 29 wherein said break-rod, when ruptured, forms first and second portions and wherein said first and second break-rod containment springs apply a force for retaining said first and second portions in said first and second rod pockets, respectively.

31. A fire alarm box comprising in combination:

(a) a unitary base fabricated of a material capable of at least some yield, without rupture, in response to an applied force;

(b) said base including a perforation therethrough for accommodating a switch stem with an integral contact control wafer;

(c) said perforation and said switch stem designed for mating relationship to inhibit any relative motion other than reciprocal longitudinal motion of said switch stem between first and second limits; and wherein (d) said switch stem and said base include cooperating elements for inhibiting movement of said switch stem from one of said limits toward the other of said limits without inhibiting the reverse movement.

32. The combination as set forth in claim 31 wherein said cooperating elements comprise a latch including a detent on the switch stem and retaining ledge on said base and wherein said detent is biased towards engagement with said retaining ledge.

33. The combination as set forth in claim 32 wherein said perforation in said base includes space to permit the insertion of a tool of predetermined configuration between said switch stem and the wall of said perforation for urging said detent against its bias to disengage it from said retaining ledge to permit motion of said switch stem in the otherwise inhibited direction.

34. The combination as set forth in claim 33 and including a switch cap coupled to said switch stem by an interlocking locking means.

35. The combination as set forth in claim 34 and including a perforation through said switch cap for permitting insertion of the tool of predetermined configuration.

36. The combination as set forth in claim 35 and including spring bias means between said base and said switch cap for urging said switch stem towards its latched position.

37. The combination as set forth in claim 36 and including a cover pivotally coupled to said base and wherein said cover includes a switch actuating member for contacting said switch cap and urging said switch stem, against the bias of said spring means, away from said latched position in response to the closing of said cover.

38. The combination as set forth in claim 37 and including a perforation in said cover which will be in alignment with the perforation through said switch cap when said cover is near its closed position whereby the tool of predetermined configuration may be passed through the perforations of said cover and said switch cap to release said detent and permit said switch actuating member to move said switch stem away from said latched position in response to the closing of said cover.

39. The combination as set forth in claim 31 wherein said cooperating elements comprise a latch including a detent on said base and a retaining ledge on said switch stem and wherein said detent is biased towards engagement with said retaining ledge.

40. The combination as set forth in claim 39 wherein said perforation in said base includes space to permit the insertion of a tool of predetermined configuration between said detent and said stem for urging said detent against its bias to disengage it from said retaining ledge to permit motion of said switch stem in its otherwise inhibited direction.

41. The combination as set forth in claim 40 and including a switch cap coupled to said switch stem by an interlocking locking means.

42. The combination as set forth in claim 41 and including a perforation through said switch cap for permitting insertion of the tool of predetermined configuration.

43. The combination as set forth in claim 42 and including spring bias means between said base and said switch cap for urging said switch stem away from its latched position.

44. The combination as set forth in claim 43 and including a cover pivotally coupled to said base and wherein said cover has pivotally coupled thereto an auxiliary cover which includes a cam element which projects through an opening in said cover and which contacts said switch cap for moving said switch stem in response to pivotal motion of said auxiliary cover.

45. The combination as set forth in claim 44 wherein said cam element of said auxiliary cover includes a perforation therethrough and aligned with a perforation through said switch cap when said auxiliary cover is in a predetermined position whereby the tool of predetermined configuration may be passed through the perforations of said cam and said switch cap to release said detent and permit movement of said switch stem away from said latched position.

46. The combination as set forth in claim 31 and including a pair of electrically isolated contact fingers disposed on opposite sides of said contact wafer and biased theretowards and wherein said contact wafer includes first and second portions which are disposed between said pair of contact fingers when said switch stem is at its first and second limits, respectively.

47. The combination as set forth in claim 46 wherein said first and second portions of said contact wafer permit and prevent electrical contact between said pair of contact fingers when said switch stem is in the first and second limits, but not necessarily respectively.

48. The combination as set forth in claim 37 wherein one of said portions of said contact wafer comprises a perforation therethrough.

49. The combination as set forth in claim 48 wherein said contact wafer includes first and second sections each of which have said first and second portions and wherein said switch stem may be inserted in the perforation of said base in first and second orientations wherein said first and second sections of said contact wafer engage said pair of contact fingers when said switch stem is oriented in said first and second orientations, respectively.

50. The combination as set forth in claim 49 wherein said first and second sections have their first and second portions in different relative positions whereby said pair of contact fingers will be and will not be electrically coupled when said switch stem is inserted in the perforation of said base in said first and second orientations, respectively, and it is at said one of its limits.

* * * * *